United States Patent [19]

Meyer

[11] Patent Number: 5,056,748

[45] **Date of Patent: * Oct. 15, 1991**

[54] PRINTED MATERIAL SUPPORT HOLDER

[75] Inventor: Stephen T. Meyer, Indianapolis, Ind.

[73] Assignee: Deflecto Corporation, Indianapolis, Ind.

[ * ] Notice: The portion of the term of this patent subsequent to Mar. 26, 2008 has been disclaimed.

[21] Appl. No.: 531,505

[22] Filed: May 31, 1990

Related U.S. Application Data

[63] Continuation-in-part of Ser. No. 7/434,435, Nov. 13, 1989, Pat. No. 5,002,249, which is a continuation of Ser. No. 7/332,538, Apr. 3, 1989, Pat. No. 4,943,024.

[51] Int. Cl.[5] ..... A47F 5/00

[52] U.S. Cl. ..... 248/316.7; 24/67.11; 24/67.9; 24/547; 248/231.8; 248/305; 248/903

[58] Field of Search ..... 248/316.7, 74.2, 231.8, 248/305, 312.1, 903; 24/67 R, 67.3, 67.9, 67.11, 546, 547, DIG. 8, DIG.9

[56] References Cited

U.S. PATENT DOCUMENTS

| | | | |
|---|---|---|---|
| D. 286,600 | 11/1986 | Meyer et al. | D6/573 |
| D. 289,122 | 4/1987 | Meyer et al. | D6/573 |
| 1,654,756 | 1/1928 | Ryan | 248/74.2 |
| 1,817,424 | 8/1931 | Smiley | 248/303 |
| 1,828,417 | 10/1931 | Keleher | 24/67.3 |
| 3,317,167 | 5/1967 | Becker et al. | 248/316.7 X |
| 3,544,053 | 12/1970 | Ingalls | 248/903 X |
| 3,913,186 | 10/1975 | Ray et al. . | |
| 4,279,396 | 7/1981 | Bendock | 248/316.7 |
| 4,332,362 | 6/1982 | Leopold . | |
| 4,335,864 | 6/1982 | Merlini . | |
| 4,351,505 | 9/1982 | Wickersham . | |
| 4,706,342 | 11/1987 | Yu | 24/67.3 X |
| 4,903,376 | 2/1990 | Rousseau | 24/67.3 X |
| 4,908,912 | 3/1990 | Grant | 24/67.3 X |
| 4,943,024 | 7/1990 | Meyer | 24/67.9 X |

FOREIGN PATENT DOCUMENTS

| | | |
|---|---|---|
| 86269321 | 2/1987 | Fed. Rep. of Germany . |
| 2291724 | 6/1976 | France . |
| 2158138A | 6/1985 | United Kingdom . |

*Primary Examiner*—Ramon O. Ramirez
*Attorney, Agent, or Firm*—Woodard, Emhardt, Naughton Moriarty & McNett

[57] ABSTRACT

A molded plastic holder for printed material includes a substantially flat support panel which is designed to be mounted to any vertical surface. Molded as part of and integrally joined to the support panel along a lower edge is a first curved clip which curves outwardly at its base so as to provide a clearance space to receive the material and then extends inwardly in order to create a pressure point which presses against any material placed in the holder in order to retain the material securely in place. Also molded as part of and integrally joined to the support panel is a second curved clip of virtually identical construction to the first curved clip. The clips each have an inherent spring tension which allows each clip to be easily pulled forward for the insertion of material into the holder and to spring back to apply the desired holding force. Snap-on legs are used when the holder is to be table-mounted.

7 Claims, 5 Drawing Sheets

PRINTED MATERIAL SUPPORT HOLDER

CROSS-REFERENCE TO RELATED APPLICATIONS

This application is a continuation-in-part application of my prior and copending patent application Ser. No. 434,435 filed on Nov. 13, 1989, U.S. Pat. No. 5,002,249 which is a continuation of application Ser. No. 332,538 filed on Apr. 3, 1989, now U.S. Pat. No. 4,943,024.

BACKGROUND OF THE INVENTION

The present invention relates in general to support holders for racks which retain printed material, files, charts and the like. More specifically, the present invention related to such holders and racks which include a retention clip to pin the received material in position.

Over the years a number of holders and receptacles for printed material have been designed. While there is great diversity in the various configurations, these holders and receptacles typically include front and rear panels and enclosing side panels. The bottom surface is typically enclosed either by a separate panel or by angling the front and rear panel such that their lower edges are in contact. The interior cavity which is defined is open and the material which is received is retained without any particular orientation or arrangement. In some designs, a series of receptacles are provided in a stack such that different types of materials can be segregated.

Typical of some of the aforementioned types of holders and receptacles are the magnetic wall pockets, utility wall pockets and desk top pockets offered by Deflecto Corporation of Indianapolis, Ind. Some of these products are covered by U.S. Pat. No. Des. 286,600 issued Nov. 11, 1986 to Meyer et al. and U.S. Pat. No. Des. 289,122 issued Apr. 11, 1987 to Meyer et al.

In each of these patented configurations the holder or receptacle (i.e, pockets) includes sides which control the dimension of the article which can be received. Although the length dimension of the article is typically turned sideways so that the extension above the pocket is minimized, there is complete freedom as to the orientation of the article. Nevertheless, having enclosing side walls does limit the versatility of the pocket due to size restrictions. Consequently, for articles whose size may vary or when the type of article to be retained in the holder is not known, pockets with these confining sides may not be suitable.

One area where such pockets have more limited use due to the nature of the articles and material to be received is in the operating and examination rooms of hospitals and clinics. In these rooms medical files and charts are typically present and there is a need to temporarily retain or store such files and charts during examination of the patient. These medical charts and files are often placed on a counter or table or are left outside of the room. If there is a need to refer to the file or enter data, then not having it in a convenient and readily accessible location contributes to confusion and a lack of organization. Another area of potential use for the present invention is in computer rooms where large printouts are moved and handled.

With the holder of the present invention, a front clip is provided to aid in retaining the articles which are placed in the holder. This clip is molded integrally as part of the holder and has a sufficient spring tension to enable various thicknesses of material to be retained.

The spring tension of the clip also creates a slight flex or bend in the received articles such that the outer edges are pushed forward and made easier to grasp. The front clip structure of the present invention is extended to another style of holder or receptacle which includes side panels that extend forward from a rear panel.

This other style according to the present invention is specifically designed to receive a large quantity of identical brochures or folders and the holder width is sized to match the width of the printed material which is received in the holder. Consider for example product and informational brochures which are distributed by businesses such as travel agencies, doctor offices, hotels, drug stores, etc. There is a need to display such informational material in an attractive manner and still maintain visibility of what is available. For instance, a drug store may wish to provide a number of health care brochures on a wide range of topics. If the cover of the brochures cannot be seen it is awkward for a person to easily select the brochure of interest. In one embodiment of the present invention two clips are arranged as part of the same holder so that two items of printed material can be received and positioned concurrently.

While a number of holders exist for magazines, catalogs, pamphlets and brochures, they all suffer from various defects in design which severely limit their aesthetic qualities and usefulness. One defect is that these holders do not provide any type of structure to cause the material to stand and remain standing in an upright orientation. If the holder is full, the material in the holder is somewhat supported by its own surrounding mass. However, as the pamphlets and brochures are taken the mass diminishes and the remaining pamphlets and brochures begin to sag and curl. Either the top edge of this material droops over in a forward direction making it difficult to read and identify, or the bottom edge curls up and the top edge drops down becoming more difficult to locate, identify and grasp.

By means of the clip of the present invention, a slight arch is created in the printed material creating a concave curvature extending from the top to the bottom with the curvature running side to side. This arch provides each item with a structural configuration which is self-supporting and this precludes the aforementioned problems of sagging and curling. The side panels of this particular holder style according to the present invention are configured with interlocking means so that several holders can be joined together as an assembled unit.

SUMMARY OF THE INVENTION

A holder for printed material according to one embodiment of the present invention comprises a substantially flat support panel, a curved clip integral with the support panel along one edge and free from the support panel around the remaining periphery of the clip, the clip having an inside surface which defines a receiving cavity with the outer surface of the support panel.

One object of the present invention is to provide an improved holder for printed material.

Related objects and advantages of the present invention will be apparent from the following description.

DESCRIPTION OF THE PREFERRED EMBODIMENT

Figure 1:
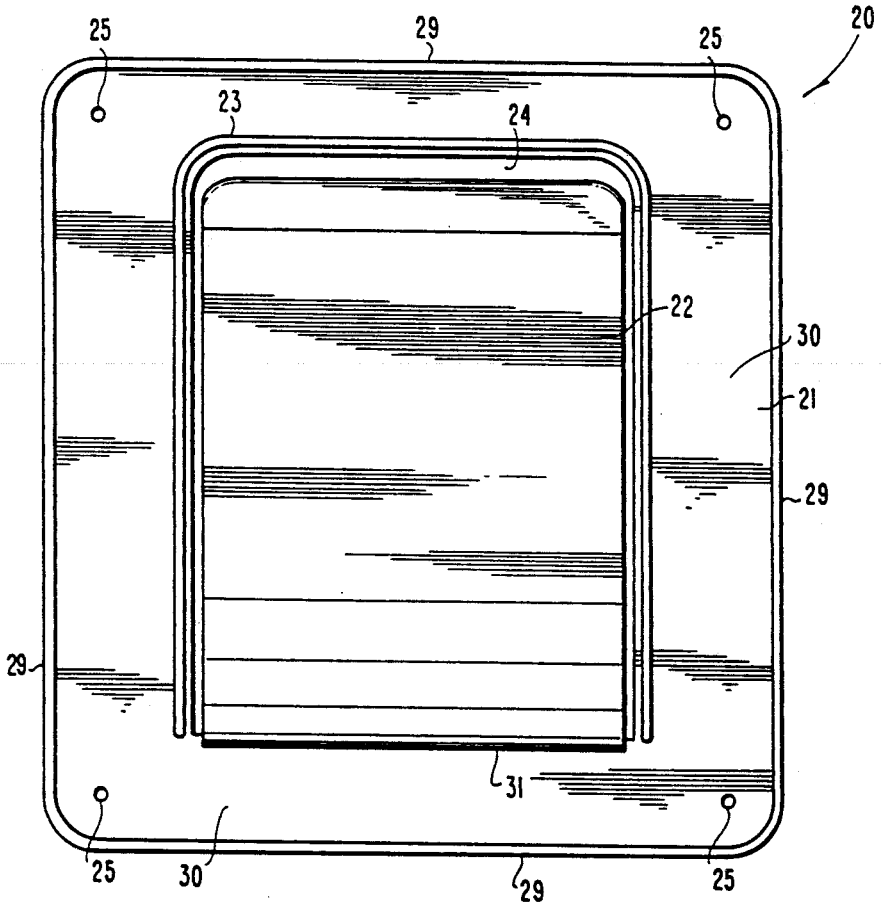
FIG. 1 is a front elevational view of a holder for printed material according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
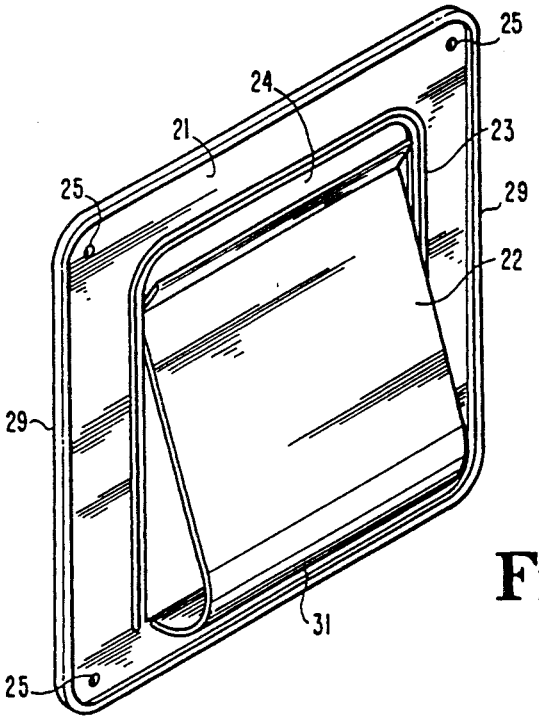
FIG. 2 is a perspective view of the FIG. 1 holder.

Referring to FIGS. 1 and 2, there is illustrated a chart and file holder 20 which includes a support panel 21, curved clip 22, stiffening rib 23, generally rectangular open area 24 and mounting holes 25. The support panel is a generally rectangular, substantially flat, integral member whose outer edge 29 is slightly thicker than the center panel portion 30 between edge 29 and rib 23 in order to provide strength and rigidity to the holder. The curved clip is injection molded integral with the panel. In the forming and molding process, the clip 22 is joined along its bottom edge to the remainder of the panel coincident with the lower edge of open area 24 (see FIGS. 2 and 3). The clip 22 is shaped and curved, the contour of which is best illustrated by the side elevational view of FIG. 3.

Figure 4:
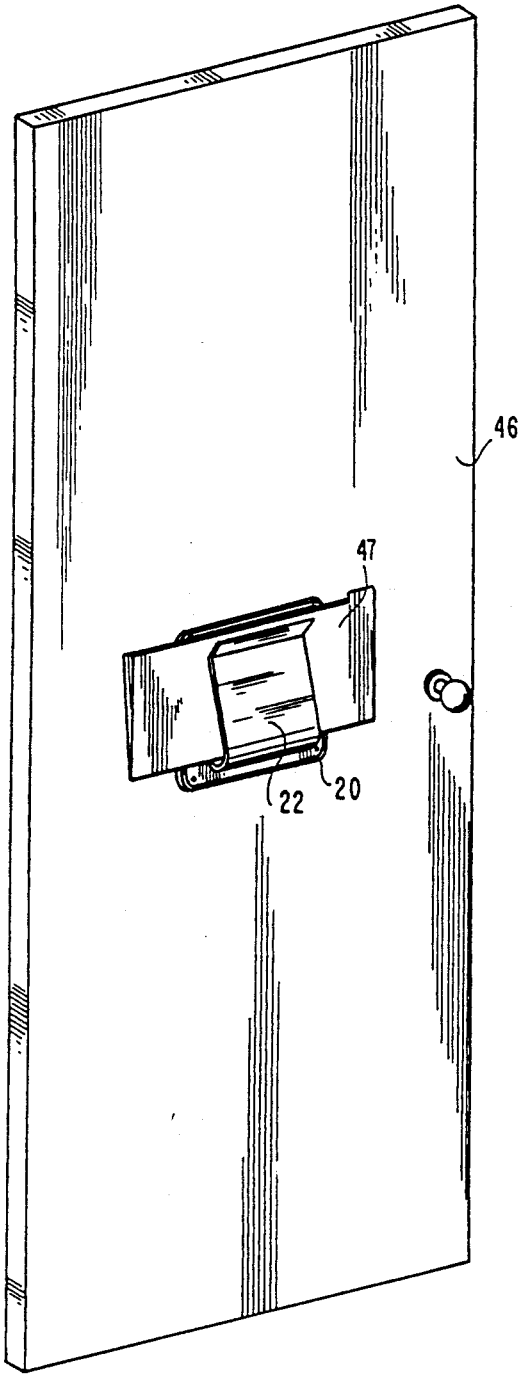
FIG. 4 is a perspective view of the FIG. 1 holder as mounted on a door and receiving therein printed material.

Rib 23 is spaced very slightly from the edges of open area 24 except for the lower edge of area 24 which is integral and coincident with the attaching edge of clip 22. Rib 23 does not extend along the lower edge of the open area. Although there are a number of raised features on the front surface of support panel 21, the rear or back surface is substantially flat thereby enabling the holder to be mounted to any substantially flat surface such as a wall or door, as is illustrated in FIG. 4. The four mounting holes 25 are provided exclusively for such mountings, though it is also envisioned that the holder will be mounted using double-sided adhesive tape. A further mounting option is to apply to the rear surface an adhesive-backed magnetic strip. Once the adhesive side is applied to the rear surface of the holder, the holder is then able to be mounted to any magnetic-attractive metal surface.

Figure 3:
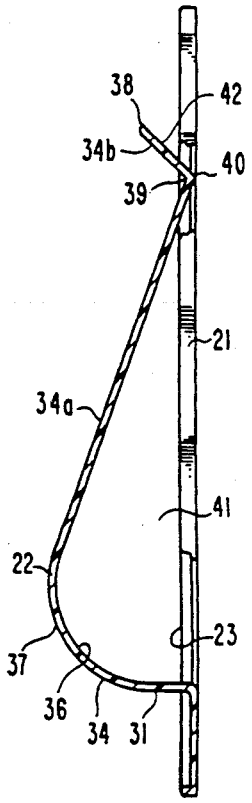
FIG. 3 is a side elevational view in full section of the FIG. 1 holder as viewed along line 3—3.

As illustrated in FIG. 3, curved clip 22 is of a substantially uniform thickness and is configured with three sections 34, 34*a* and 34*b*. Section 34 curves outwardly and upwardly from bottom edge 31 and is configured with a smoothly curved concave inner surface 36 and convex outer surface 37. Section 34*a* is a substantially flat portion extending inwardly and upwardly from section 34 and ending at inside corner 39. The top section 34*b* which is substantially flat extends outwardly and upwardly from corner 39 to top edge 38. Outside corner (edge) 40 provides a pressure point for clip 22 which presses against any article placed in holder 20. It is the shape of clip 22 which provides both an open cavity 41 to receive files and charts, a lower support surface via surface 36 and a pressure point via edge 40. The outwardly flared top edge 38 is spaced slightly from support panel 21 and thereby creates a channel 42 which opens upwardly and is the point of initial entry of any chart or file placed in holder 20. In the exemplary embodiment, the plane of edge 40 extends slightly into open area 24 and is thus substantially coincident with the plane of the support panel, though this configuration can be varied by the molding process. The farther edge 40 extends toward or into the plane of support panel 21 the greater the spring tension on articles placed in the holder by the clip. The inherent spring tension which is molded into the clip and its attachment to panel 21 provides flexibility and allows edge 40 to pivot outwardly.

As is illustrated in FIG. 4, holder 20 may be mounted on a door 46 and files placed in the holder. In the illustrated example, the file is somewhat longer than the width of the holder and thus the ends of the file extend beyond both sides of clip 22. File 47 is arranged laterally for better balance and although the clip 22 is wide, its width is substantially less than the length of the files thus allowing the outer edges of the files to remain accessible and easily grasped in order to remove the file, chart, computer printout or the like from the holder. Clip 22 presses against file 47 causing the outer edges to flex forward for easier grasping.

Figure 5:
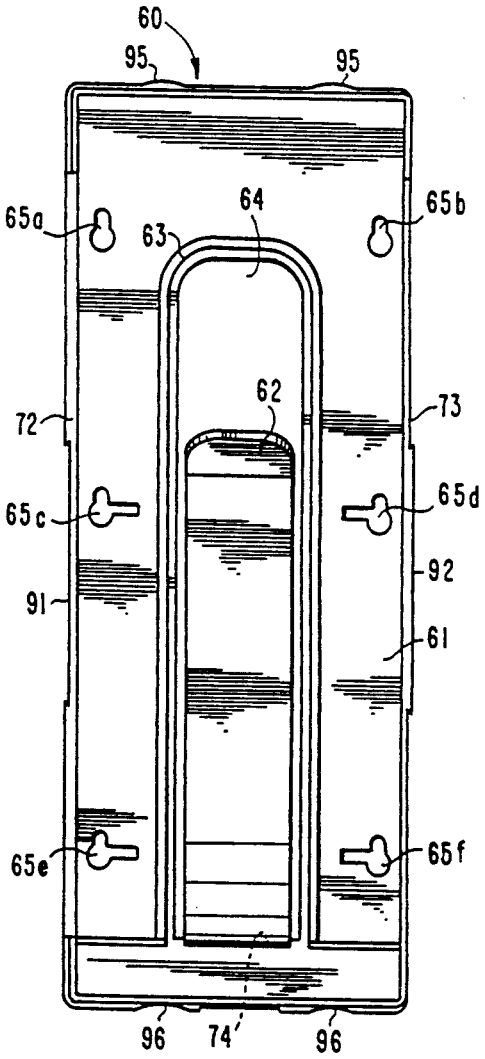
FIG. 5 is a front elevational view of a printed literature holder according to a typical embodiment of the present invention.
Figure 5A:
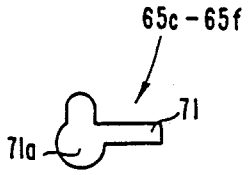
FIG. 5A is a detail of a mounting hole configuration comprising a portion of the FIG. 5 holder.
Figure 6:
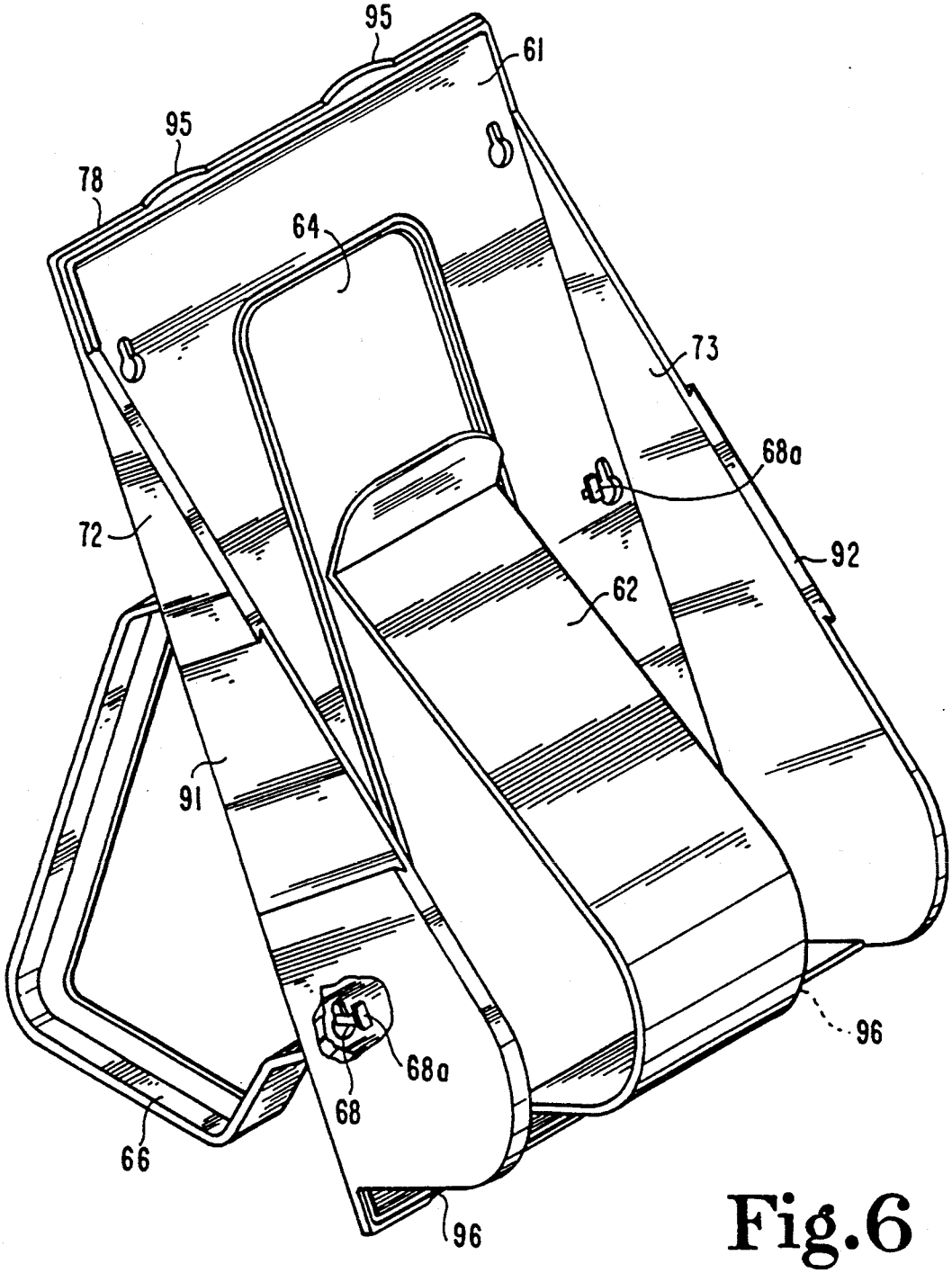
FIG. 6 is a perspective view of the FIG. 5 holder.

Referring to FIGS. 5 and 6, there is illustrated another holder according to the present invention. Holder 60 includes support panel 61, curved clip 62, stiffening rib 63, open area 64 and support holes 65*a*–65*f*. Holes 65*a*–65*f* are arranged into two groups or patterns. The first group includes the top two holes 65*a* and 65*b*. These holes are used if the holder 60 is mounted to a flat surface such as a vertical wall or door. If holder 60 is to be used on a table or countertop, then holes 65*c*, 65*d*, 65*e* and 65*f* are used to attach snap-on legs 66 and 67 (see FIGS. 6 and 7). One or more of the holes 65*c*–65*f* may also be used with holes 65*a* and 65*b* when holder is 60 is mounted to a wall or door. Holes 65*a* and 65*b* are configured with a keyhole shape and while the other four holes have this same shape in part, these other four holes also include a lateral slot 71 as illustrated in the detail of FIG. 5A.

It is to be understood that holder 60 is virtually identical to holder 20 as to the general shape and configuration, including the shape of the curved clip 62. The most significant differences between the two holders include the snap-on legs as a mounting option, side panels 72 and 73 and a series of ridges 74 disposed at the base 75 of the clip where it is joined to and integral with the support panel 61.

Support panel 61 is generally rectangular and substantially flat and is integrally molded with clip 62 and with tapered and curved side panels 72 and 73. Stiffening ribs 63 surrounds the three sides of open area 64 and provides strength and rigidity to the support panel 61. Side panels 72 and 73 each extend from a point slightly below the top edge 78 of panel 61 and flare downwardly and outwardly to a convex outer curved portion that generally coincides with the shape of the lower part of clip 62. Clip 62 includes a lower curved portion 79 which has a concave inner surface 80 which in combination with the outer or front surface of panel 61 defines a receiving cavity 81. Extending between inside corner 83 and portion 79 is a substantially flat portion 79*a*. Extending between inside corner 83 and outer, upper edge 82 is substantially flat lip 86 which includes outer surface 84 and inner surface 85. The corner or edge opposite to corner 83 provides the pressure point for clip 62. The outwardly flared nature of lip 86 provides channel 87 which is the initial point of entry for printed literature which is placed in holder 60.

Figure 7:
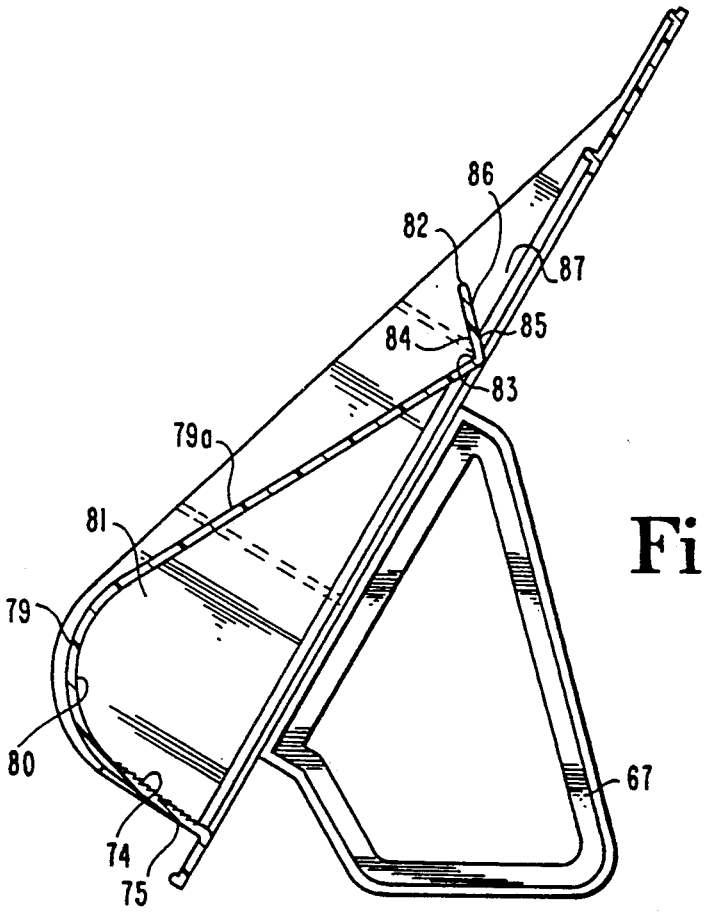
FIG. 7 is a side elevational view of the FIG. 5 holder.

FIG. 6 is a perspective view of holder 60 as viewed from the left side and FIG. 7 is a side elevational view taken from the right side. These two views are important in order to adequately and completely illustrate the nature of side panels 72 and 73 and to show the nature and attachment of snap-on legs 66 and 67. As is intended to be illustrated, legs 66 and 67 each include a pair of aligned buttons 68 with enlarged heads 68*a* which are sized and spaced to fit into holes 65*c*–65*f*. As is intended to be illustrated and described, the stem of the buttons on legs 66 and 67 are of a smaller size such that the enlarged head of each button must be first placed in the large circular opening 71*a* of each hole and as pushed into position the stem of each button aligns with the lateral slot 71 allowing the stem of the button to be received in the slot and the head of the button extending over and beyond the slot edges so as to function as a locking means. Leg 66 is attached via holes 65*c* and 65*e* and leg 67 is attached by hole 65*d* and 65*f*. Once the buttons are fitted into their respective holes and slide laterally into corresponding slots 71, the legs are locked to the back surface of support panel 61.

Figure 8:
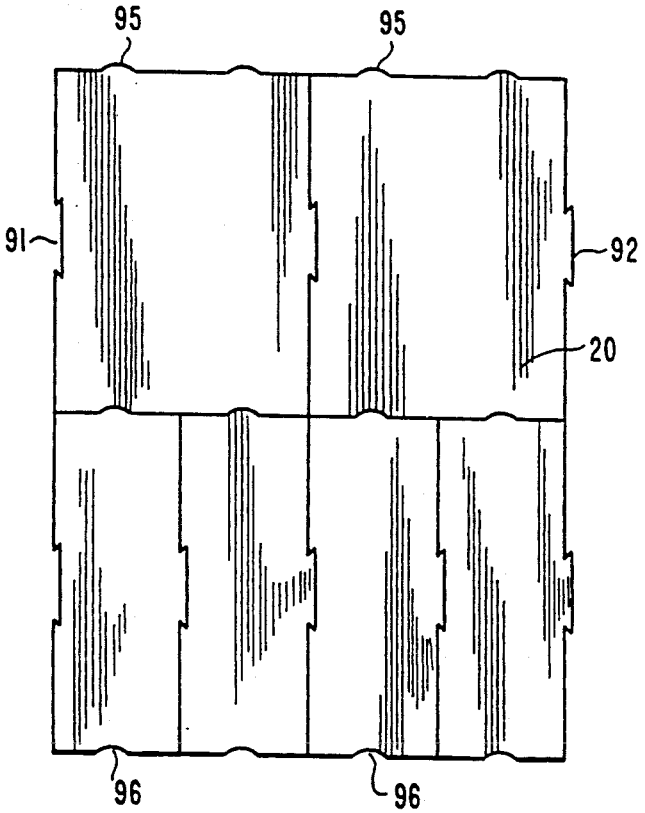
FIG. 8 is a diagrammatic illustration of several holders according to the style of FIG. 5 joined together in an interlocked assembly.

One function of side panels 72 and 73 is to provide lateral support and control of whatever printed literature may be placed in the holder. These particular side panels are spaced so as to be substantially parallel to each other and are set at a width which is only slightly greater than the width of the printed material which the holder receives. Although larger holders can support any size material which is smaller than the lateral spacing in the side wall, the most attractive appearance and use of holder 60 is to have the width between side panels substantially the same as, though slightly larger, the width of the material received therein. Another function provided by the two side panels is a way to interlock adjacent holders together. The outer surface of side panel 72 includes a recessed area 91 which tapers slightly from the front of the area to the rear. A matching and complementary raised boss 92 is disposed on the outer surface of side panel 73. The raised boss 92 tapers slightly from the front to the rear and its size and shape match the recessed area 91 such that adjacently disposed holders can be interlocked by locking the raised boss of one holder into the recessed area of the adjacent holder. In order to enhance the interlocking configuration, the recessed area and the raised boss are formed with angled and cut top and bottom edges similar to what would be described as a dovetail fit. Although the present invention has been generally described as having a selective or predetermined spacing between the side panels, it is anticipated that standard sizes will accommodate most of the printed literature which may be disposed in holders such as this. A full-size holder will typically be used for full-size material such as that material having an approximate 8½ inch width. Since the 8½ inch width generally coincides with regular size letters, stationery and brochures, it is anticipated that this size will accommodate a wide range of publications. For placement of such items as pamphlets and folded brochures in the holder, these particular items are typically half-sized with a width in the range of 4 to 4¼ inches. Consequently, another standard size for holder 60 will be one which has a spacing between side panels 72 and 73 set slightly larger than the 4¼ inch anticipated width. If the full-size and half-size holders are designed with a 2:1 size relationship, then it will be possible to create a mixture of both full size and half-size holders all interlocked together in a wide variety of arrangements, one of which is illustrated in FIG. 8. The point to be stressed though is that one full size holder can be replaced by two half-sized holders due to their uniformity of a 2:1 size relationship. Consequently, it is important that the recessed area 91 and raised boss 92 of every holder regardless of whether it is full-sized or half-sized be maintained the same so that full-size and half-size holders can interlock with each other.

Also illustrated in FIG. 8 is another feature of the present invention wherein the top edge of the support panel is configured with two raised portions 95. The bottom edge of the support panel includes an aligned pair of recessed portions 96. This particular pattern allows holders to be aligned with one another in a top-to-bottom stack and although the nature of these raised and recessed portions does not provide the same dovetail interlock as was available with the side panels, it does enable a tight engagement and a self-aligning feature so that a series of holders can be arranged to cover some portion of a wall or door. The interlocking feature of the side panels can also be used when the holders are supported by the legs on a horizontal surface, though in that particular configuration it is not anticipated that the alternating raised and recessed portions along the top and bottom edges will be utilized. The combination of interlocked holders diagrammatically illustrated in FIG. 8 includes two full-size holders 60 which are interlocked side by side and four half-size holders 97 which are interlocked side by side and the two groups are engaged by means of their top and bottom edges. The features of the holders has been eliminated for drawing clarity since the role of FIG. 8 is to show only the edge-to-edge engagements.

In use, the clip 62 puts a slight arch in the printed material which is placed within the holder and this arch serves to support the material and have it remain upright. The arch does not allow the material to slide down and the bottom edge curl upwardly. Another feature which aids in the retention of literature in an upright fashion are the ridges 74 in the base of the clip. The bottom edges of the material which is placed in the holder will contact and abut these ridges and the material is precluded from drooping or curling.

Figure 9:
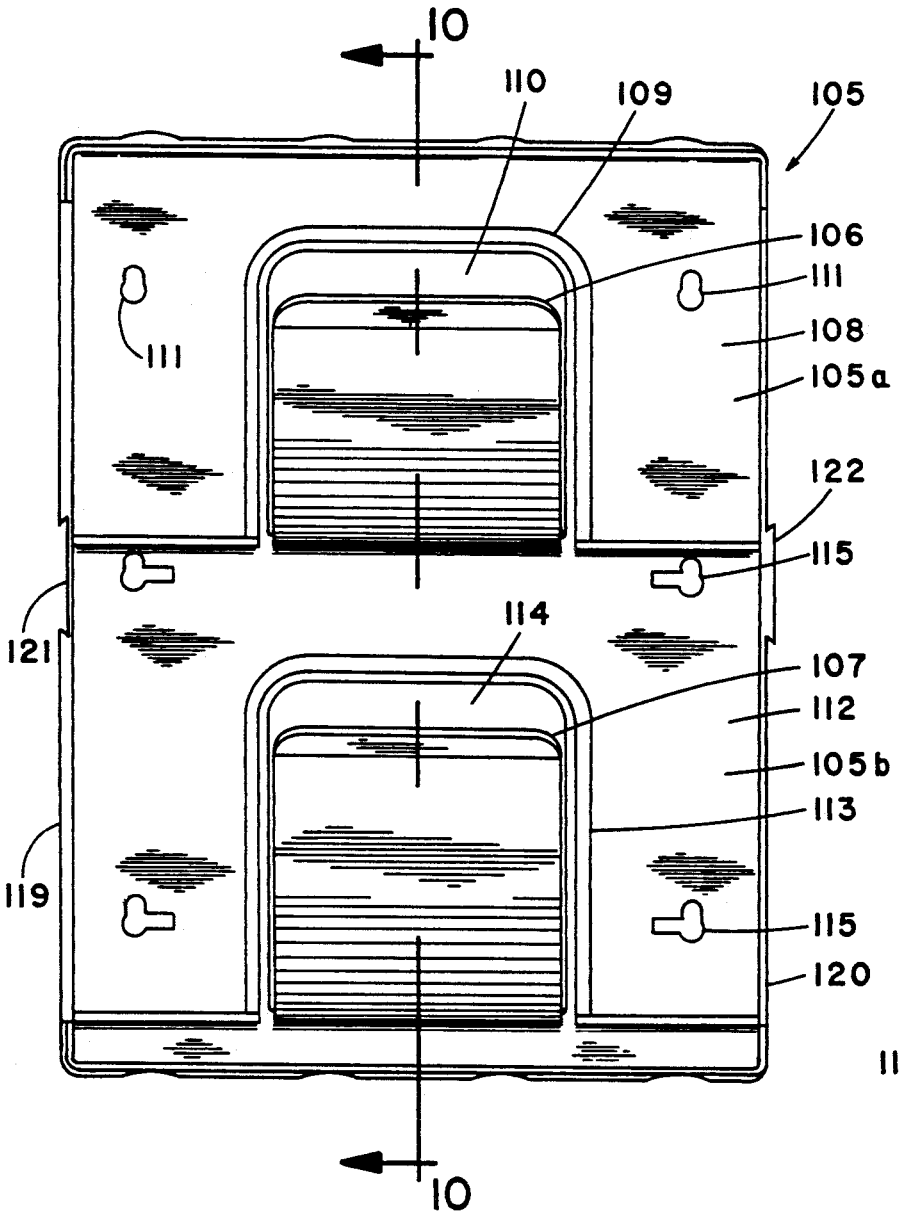
FIG. 9 is a front elevational view of a printed literature holder providing two clips according to a typical embodiment of the present invention.
Figure 10:
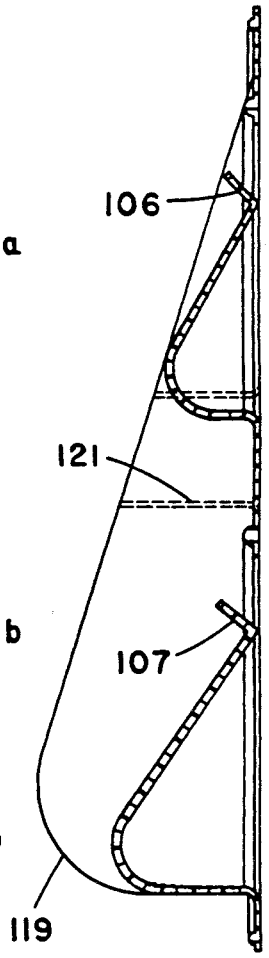
FIG. 10 is a side elevational view in full section of the FIG. 9 two-clip printed literature holder as viewed along line 10—10.

Referring to FIG. 9, there is illustrated another embodiment of the present invention wherein holder 105 includes two clips 106 and 107. With minor exceptions, holder 105 can be viewed as two holders stacked one on top of the other. The upper holder portion 105*a* associated with clip 106 includes a substantially flat support panel portion 108, stiffening rib 109, open area 110 and support holes 111. The lower holder portion 105*b* associated with clip 107 includes a substantially flat support panel portion 112, stiffening rib 113, open area 114 and support holes 115.

The remainder of holder 105 is quite similar to holder 60 including side panels 119 and 120. The outer surface of side panel 119 includes recessed area 121 which tapers slightly from the front to the rear. A matching and complementary raised boss 122 is disposed on the outer surface of side panel 120. The raised boss 122 is sized and shaped in order to match the recessed area 121 such that adjacently disposed holders can be interlocked by locking the raised boss of one holder into the recessed area of the adjacent holder. In order to enhance the interlocking configuration, the recessed area and the raised boss are formed with angled and cut top and bottom edges similar to what would be described as a dovetail fit.

Another aspect of holder 105 which is similar to that illustrated for holder 60 is that the top edge of the support panel is configured with two raised portions and the bottom edge of the support panel includes an aligned pair of recessed portions. As previously described, this particular pattern allows holders to be aligned with one another in a top-to-bottom stack and although the nature of these raised and recessed portions does not provide the same dovetail interlock as was available with the side panels, it does enable a tight engagement and a self-aligning feature so that a series of holders can be arranged to cover some portion of a wall or door.

As was described for holder 60, the four mounting holes 115 of the lower holder portion 105*b* are each of a special configuration, designed to receive snap-on legs, such as legs 66 and 67, though sized to match holder 105. It should be noted that a dual clip holder similar to holder 105 can be styled based upon the structure of holder 20 by extending the vertical height of the support panel and adding a second clip. Otherwise, the open area, stiffening ribs, and mounting holes will be virtually identical between a single clip holder and a double clip holder.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A holder for printed material and the like comprises:

a substantially flat support panel;

a first curved clip having a lower edge which is integrally joined to said support panel and an upper edge, said first curved clip being curved outwardly and upwardly from said lower edge and extending back toward said support panel as it extends toward said upper edge;

a second curved clip having a lower edge which is integrally joined to said support panel and an upper edge, said second curved clip being curved outwardly and upwardly from said lower edge and extending back toward said support panel as it extends toward said upper edge; and a pair of side panels which are disposed on opposite sides of said support panel and integrally joined therewith.

2. A holder for printed material and the like comprises:

a substantially flat support panel arranged so as to define a plurality of modified mounting holes which are designed and arranged to position said holder in a desired orientation;

a first curved clip having a lower edge which is integrally joined to said support panel and an upper edge, said first curved clip being curved outwardly and upwardly from said lower edge and extending back toward said support panel as it extends toward said upper edge;

a second curved clip having a lower edge which is integrally joined to said support panel and an upper edge, said second curved clip being curved outwardly and upwardly from said lower edge and extending back toward said support panel as it extends toward said upper edge; and a pair of snap-on legs each of which are suitably configured to attach to one of said plurality of mounting holes.

3. A holder for printed material and the like comprises:

a substantially flat support panel having a tope edge which includes a series of raised portions and having a lower edge which includes a series of recessed portions wherein one holder is able to interfit with an adjacent holder on either of the top or bottom;

a first curved clip having a lower edge which is integrally joined to said support pane land an upper edge, said first curved clip being curved outwardly and upwardly from its lower edge and extending back toward said support panel as it extends toward the upper edge of said first curved clip; and a second curved clip having a lower edge which is integrally joined to said support panel and an upper edge, said second curved clip being curved outwardly and upwardly from its lower edge and extending back toward said support panel as it extends toward the upper edge of said second curved clip.

4. A holder for printed material and the like comprises:

a substantially flat, generally rectangular support panel having first and second interior openings defined by a surrounding frame, and further including a plurality of attachment locations for securing said holder to a vertical surface;

a first curved clip having a lower edge which is integral with said support panel and coincident with an edge of said first interior opening, said first curved clip having an upper edge and contoured so as to define an upward opening recess between said upper edge and said support panel; and a second curved clip having a lower edge which is integral with said support panel and coincident with an edge of said second interior opening, said second curved clip having an upper edge and contoured so as to define an upward opening recess between said upper edge and said support panel.

5. A holder for printed material and the like comprises:

a substantially flat support panel;

a first clip having a lower edge which is joined to said support panel and an upper edge, said first clip extending outwardly and upwardly from said lower edge and then extending back toward said support panel as said firs clip extends toward said upper edge;

a second clip having a lower edge which is joined to said support panel and an upper edge, said second clip extending outwardly and upwardly from said lower edge and then extending back toward said support panel as said second clip extends toward said upper edge; and a pair of side panels which are disposed on opposite sides of said support panel.

6. A holder for printed material and the like comprises:

a substantially flat support panel arranged so as to define a plurality of modified mounting holes which are designed and arranged to position said holder in a desired orientation;

a first clip having a lower edge which is joined to said support panel and an upper edge, said first clip extending outwardly and upwardly from said lower edge and then extending back toward said support panel as said first clip extends toward said upper edge;

a second clip having a lower edge which is joined to said support panel and an upper edge, said second clip extending outwardly and upwardly from said lower edge and then extending back toward said support panel as said second clip extends toward said upper edge; and a pair of snap-on legs, each of which are suitably configured to attach to one of said plurality of mounting holes.

7. A holder for printed material and the like comprises:

a substantially flat support panel having a top edge which includes a series of raised portions and having a lower edge which includes a series of recessed portions wherein one holder is able to interfit with an adjacent holder on either the top or bottom;

a first clip having a lower edge which is joined to said support panel and an upper edge, said first clip extending outwardly and upwardly from its lower edge and then extending back toward said support panel as said first clip extends toward its upper edge; and a second clip having a lower edge which is joined to said support panel and an upper edge, said second clip extending outwardly and upwardly from its lower edge and then extending back toward said support panel as said second clip extends toward its upper edge.

* * * * *

UNITED STATES PATENT AND TRADEMARK OFFICE

CERTIFICATE OF CORRECTION

PATENT NO. : 5,056,748

DATED : October 15, 1991

INVENTOR(S) : Stephen T. Meyer

It is certified that error appears in the above-identified patent and that said Letters Patent is hereby corrected as shown below:

In column 8, line 33, please change "pane land" to --panel and--.

Signed and Sealed this

Twenty-sixth Day of January, 1993

*Attest:*

STEPHEN G. KUNIN

*Attesting Officer*

*Acting Commissioner of Patents and Trademarks*